US007462213B2

(12) United States Patent
Spengler

(10) Patent No.: US 7,462,213 B2
(45) Date of Patent: Dec. 9, 2008

(54) METHOD OF MINIMIZING CROSS CONTAMINATION BETWEEN CLEAN AIR ROOMS IN A COMMON ENCLOSURE

(76) Inventor: Charles W. Spengler, 3024 W. Prospect Rd., Fort Collins, CO (US) 80526

( * ) Notice: Subject to any disclaimer, the term of this patent is extended or adjusted under 35 U.S.C. 154(b) by 472 days.

(21) Appl. No.: 11/258,057

(22) Filed: Oct. 26, 2005

(65) Prior Publication Data

US 2007/0089383 A1 Apr. 26, 2007

(51) Int. Cl.
*B01D 50/00* (2006.01)

(52) U.S. Cl. ..... 55/385.2; 55/312; 55/315; 55/318; 55/327; 55/332; 55/486; 55/472; 55/473; 95/273; 454/187

(58) Field of Classification Search ..... 55/385.2, 55/312, 315, 318, 327, 332, 486, 472, 473; 95/273; 454/187
See application file for complete search history.

(56) References Cited

U.S. PATENT DOCUMENTS 5,096,477 A * 3/1992 Shinoda et al. ..... 55/385.2
5,326,316 A * 7/1994 Hashimoto et al. ..... 454/187
5,364,425 A * 11/1994 Simon et al. ..... 55/385.2
5,626,820 A * 5/1997 Kinkead et al. ..... 422/122
5,833,727 A * 11/1998 Skarsten ..... 55/385.2
7,354,473 B2 * 4/2008 Fuchs et al. ..... 95/273
2005/0132677 A1 * 6/2005 Bauer et al. ..... 55/385.2

* cited by examiner

*Primary Examiner*—Jason M Greene
*Assistant Examiner*—Minh-Chau T Pham
(74) *Attorney, Agent, or Firm*—Ronald E. Greigg

(57) ABSTRACT

A method of operating a plurality of clean room in a compound within a common enclosure and supplying each room with filtered air by a blower-filter unit by arranging the clean rooms and the blowers connected thereto in two parallel spaced rows with a corridor therebetween, and permitting filtered air to escape the clean rooms from beneath the walls of the clean rooms. Continuous operation of the blowers produces a bubble-like volume of air surrounding the blowers which consists primarily of clean, recirculated air escaping from the clean rooms. By arranging the clean rooms and blowers so that the clean air bubble produced by each blower overlaps the bubbles produced by at least two other blowers, the entire compound can be contained in a highly purified atmosphere consisting primarily of recirculated filtered air. A portion of the air from one or more clean rooms may be discharged in an upward direction through an opening in its top wall.

17 Claims, 5 Drawing Sheets

METHOD OF MINIMIZING CROSS CONTAMINATION BETWEEN CLEAN AIR ROOMS IN A COMMON ENCLOSURE

BACKGROUND OF THE INVENTION

1. Field of the Invention

This invention relates to the operation of multiple clean rooms in a compound within a common enclosure structure, and more particularly to a method of minimizing contamination in the rooms and minimizing cross contamination between the rooms.

2. Description of the Prior Art

It is well known, particularly in life sciences laboratories, to provide a plurality of individual clean rooms in a larger common enclosure structure, or room. The clean rooms may be relatively rigid enclosures or portable structures including a self-supporting framework covered with a flexible sheet material such as a vinyl sheet, with the individual enclosures having one or more blower-filter units (hereinafter, blowers) for continuously providing a flow of air through high efficiency particulate air filters (HEPA filters) to the room. One known vinyl covered clean room arrangement is disclosed, for example, in my prior U.S. Pat. No. 4,804,392, the entire disclosure of which is incorporated herein by reference. The blowers used with such clean rooms typically have a capacity to completely replenish the air in the rooms at least about once every minute of operation, with the air escaping the rooms primarily beneath the bottom edges of the flexible walls.

It is also known to operate clean rooms under a slight negative, or sub-atmospheric pressure, in which case the blowers typically draw air from within the room, again through HEPA filters, and discharge the filtered air into the atmosphere within the common enclosure, and air is replaced in the rooms primarily through filters contained in inlets in the walls or top of the rooms.

In the operation of laboratories employing multiple portable clean rooms such as the clean room described in my prior patent mentioned above, a compound of individual clean rooms are typically arranged in end-to-end or side-to-side relation in parallel rows within the enclosure structure, with an access corridor between the rows, and with the blowers positioned behind the individual rooms on the side thereof opposite the access corridor, or with sufficient space between adjacent rooms in each row to accommodate the blowers located therebetween and to provide access to the blowers for servicing, and with the rows spaced apart to provide an access corridor. Access to the individual clean room is provided, for example, through an air lock-enclosed access curtain or wall in the sidewall of the individual room facing the access corridor between the rows. It is also known to locate the blowers on the top of the individual clean rooms.

SUMMARY OF THE INVENTION

It has been discovered that operation of the clean room blowers results in air previously filtered and escaping from the rooms being drawn back into the blowers, along with ambient air from the enclosed structure. With continuous operation, the proportion of previously filtered air surrounding the blowers increases and can, in effect, produce a clean air bubble consisting of up to about 90% or more of previously filtered air, thus correspondingly increasing the portion of refiltered air entering the clean rooms and increasing the efficiency of the filters.

The present invention takes advantage of this clean air bubble concept in an installation employing a compound of clean air rooms in a common enclosure by rearranging the position of the blowers attached to the individual clean air room, and arranging the clean air rooms in the compound in relation to one another so that the clean air bubbles created by the individual blower units overlap one another throughout the compound. Thus, in effect, a large clean air bubble is produced which encompasses the entire compound creating a high level of cleanliness in the area between and surrounding the adjacent clean rooms and through which personnel and materials pass, thereby minimizing the potential for contamination entering the clean rooms. This may be accomplished by employing at least two and preferably three blowers with each clean room, with the blowers and clean rooms arranged in a compound so that the clean air bubbles created by each blower unit overlaps the bubbles created by adjacent blower units throughout the compound. If desired, the blowers can be arranged to provide a higher concentration of previously filtered air in the area of the access openings to the clean rooms, or in the areas traversed most frequently by personnel working in the area. The size of the clean rooms and the capacity of the blowers will to some extent influence the number of blowers used and the arrangement of the blowers and clean rooms in the compound.

It has also been found that the bubble effect can be enhanced, at least in some enclosure structures, by permitting a portion of the air from within the individual clean room to escape through an opening in the top wall of the room to thereby increase the effective height of the clean air bubble surrounding the clean rooms. The percentage of previously filtered air can also be increased in selected areas, such as near the air-lock access areas, by permitting limited air escape from the top in the vicinity of the access areas. The amount of air escaping from the top may easily be controlled by providing one or more closable or partially closable openings in the top wall of the room.

BRIEF DESCRIPTION OF THE DRAWINGS

Other features and advantages of the invention will become apparent from the following detailed description, taken in conjunction with the drawings, in which.

DESCRIPTION OF THE PREFERRED EMBODIMENTS

Figure 1:
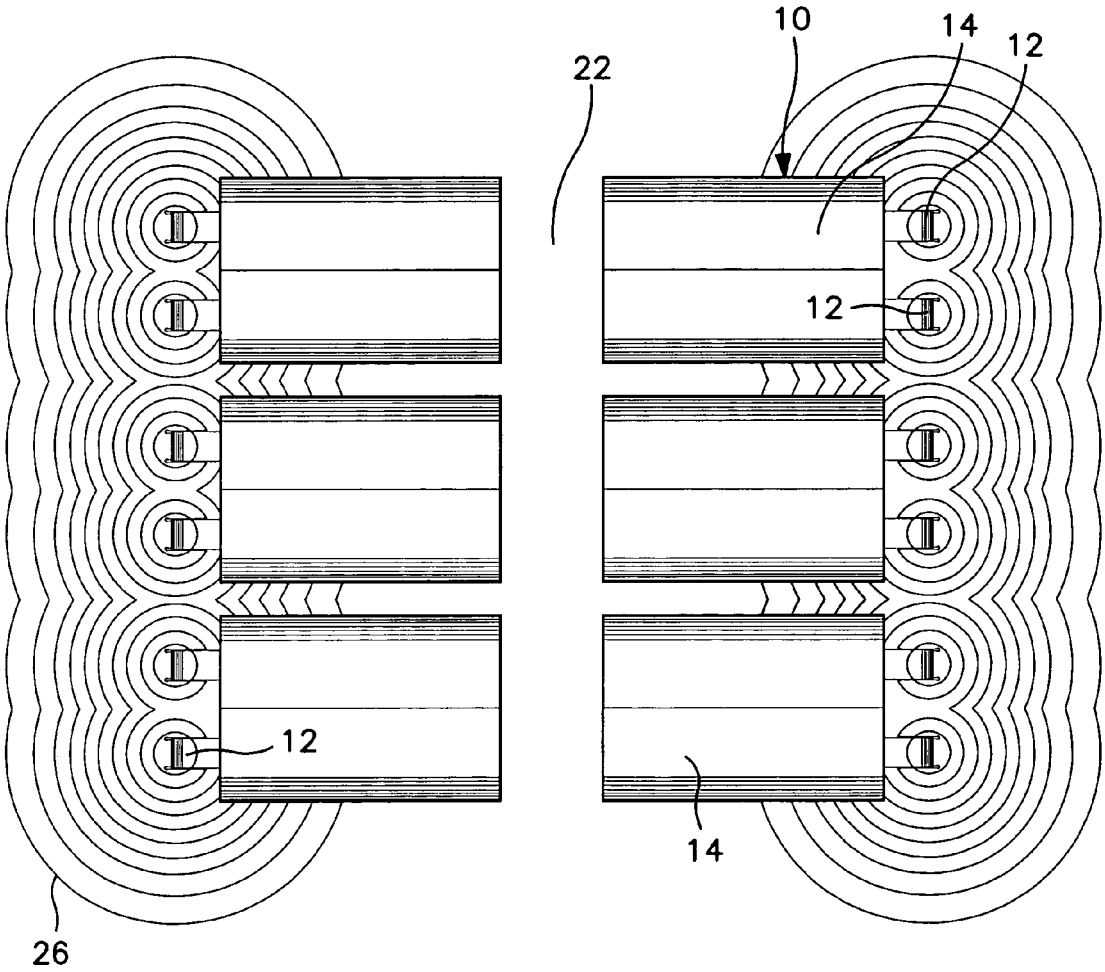
FIG. 1 PRIOR ART
FIG. 1 is a plan view of the conventional portable clean room and blower arrangement in a group of clean rooms in a common enclosure, with the blowers arranged in back of the clean rooms on the wall thereof opposite the access corridor.
Figure 2:
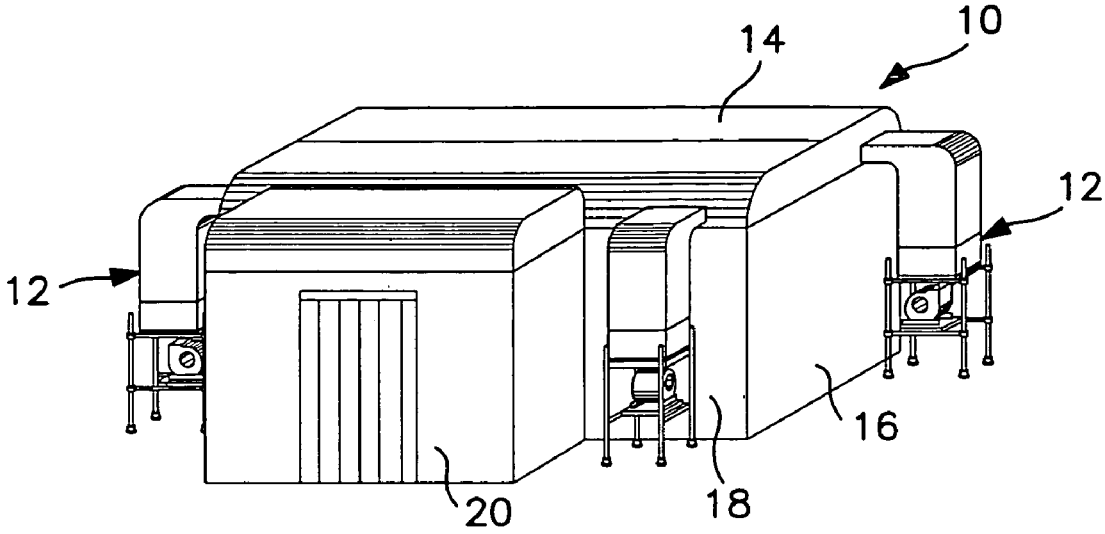
FIG. 2 is a perspective view of a portable clean air room with three blowers for use in a compound according to the invention.

Referring now to the drawings in detail, FIG. 1 shows a conventional arrangement of a group—in this case, six—of portable clean air rooms 10 arranged in two parallel rows and with each clean room equipped with two generally identical blower units 12 located at the end wall opposite the access corridor 13 between the two rows. It is pointed out that the prior art clean air rooms that employed such arrangements may only employ a single blower unit or as may as three blowers for each clean air room in a group. The clean air rooms 10 may be of the type disclosed in my prior U.S. Pat. No. 4,804,392 mentioned above, with each room 10 consisting of an open, self supporting tubular framework covered with vinyl sheet material forming a top wall 14, end walls 16 and sidewalls 18. An access opening (not shown) in one sidewall or end wall facing corridor 22 is enclosed by an air lock entrance 20, as best seen in FIG. 2.

The in-line arrangement of the clean rooms 10 in two spaced parallel rows with the air-lock entrances 20 located in the corridor 22 between the two rows enables easy docking of autoclave containers or the like and provides easy and convenient access to each room. The clean air bubbles 26 created by operation of the blowers 12 are schematically illustrated by the expanding concentric circles surrounding each blower. As is apparent from FIG. 1, the effect of any clean air bubbles created by the blowers 12 on the open corridor 22 between the two rows of clean rooms is minimal so that contamination from this area can readily be carried into the clean rooms by personnel and materials moving through the corridor and into the rooms.

Figure 3:
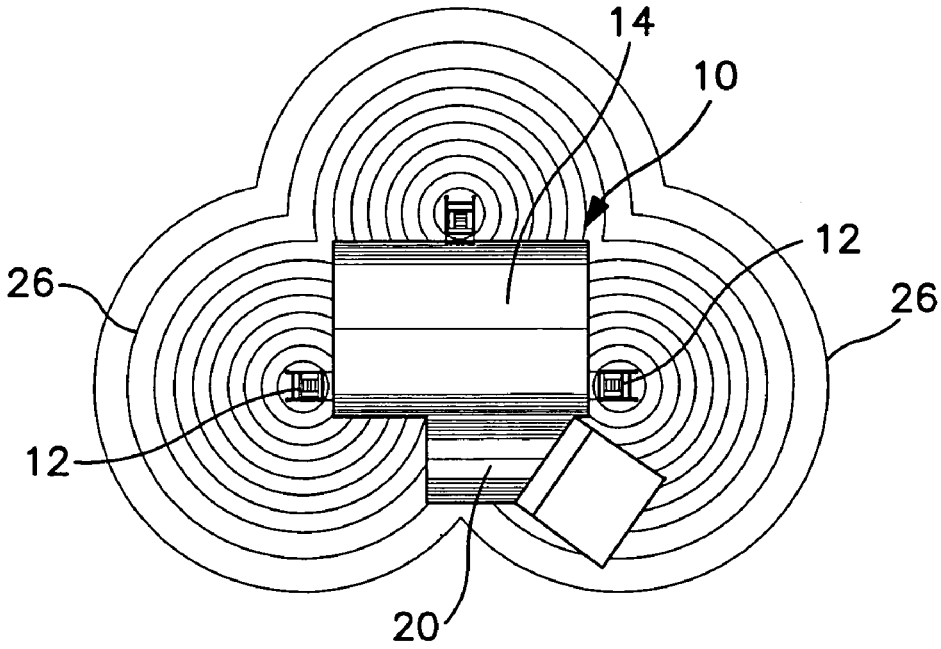
FIG. 3 is a top view of a clean room with three blowers and illustrating the overlapping clean air bubbles created by the blowers.
Figure 4:
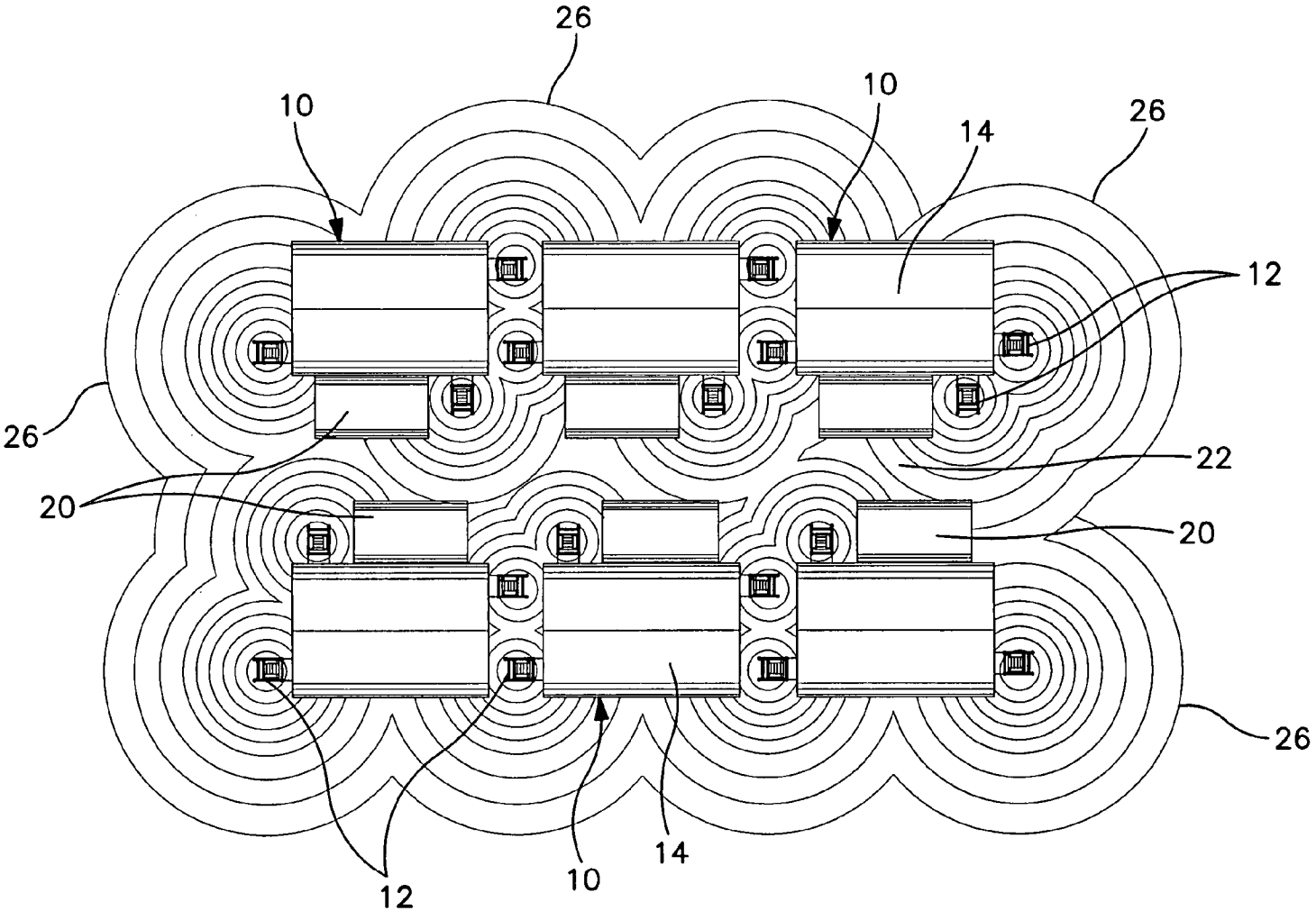
FIG. 4 is a plan view similar to FIG. 1 showing six portable clean air rooms and blowers arranged in a compound according to the invention.

The method according to the invention for maximizing the effect of the clean air bubbles 26 on the cleanliness of the clean rooms 10 is illustrated in FIG. 3. According to this arrangement, each elongated, rectangular clean room is equipped with three blowers 12, one at each end wall thereof at generally diametrically opposed corner portions of the room 10, and a third blower 12 located at one sidewall 18 of the room 10 adjacent the air lock 20. This arrangement permits easy access to each blower 12 for service and maintenance, and at the same time does not obstruct the corridor 22 between the two opposed, parallel rows of clean rooms.

As schematically illustrated by the expanding pattern of concentric circles, or arcs, surrounding each blower clean air bubbles 26 surrounding the respective blowers form an overlapping array which completely encompasses the entire clean room compound. This array of bubbles extends upwardly in a generally dome-like shape which, depending on the height of the ceiling of the enclosure structure, may be substantially semi-spherical, so that the array encompasses the clean room compound both vertically and horizontally.

As explained above, each dome-like clean air bubble 26 is formed as a result of a blower drawing in air from its immediate surroundings adjacent its associated clean room, and discharging the air through a suitable filter into the interior of that clean room. As the filtered air escapes the clean room, primarily under the bottom edges of the flexible end walls and sidewalls, this previously filtered air tends to dilute and displace the ambient air in the vicinity of the clean rooms until, with continuous operation, the air drawn into the inlet of the blower will consist of from at least about 75% to more than 90% previously filtered and recirculated air. The percentage of recirculated air entering each blower will be influenced to some extent on the ventilating system of the enclosing building structure and the location of the blower relative to the other blower, but it has been discovered that arranging the blowers in a pattern to produce overlapping clean air bubbles not only increases the proportion of previously filtered air circulated by each blower, but that the combined effect produces a highly purified atmosphere enveloping the entire colony of clean rooms. This greatly reduces the chances of cross-contamination by personnel and materials moving between and through the clean rooms of the compound. Further, this protection against cross-contamination can be enhanced by arranging the blowers to produce greater overlap of the bubbles in the area between the parallel rows of clean rooms and in the vicinity of the clean room air locks.

Figure 5:
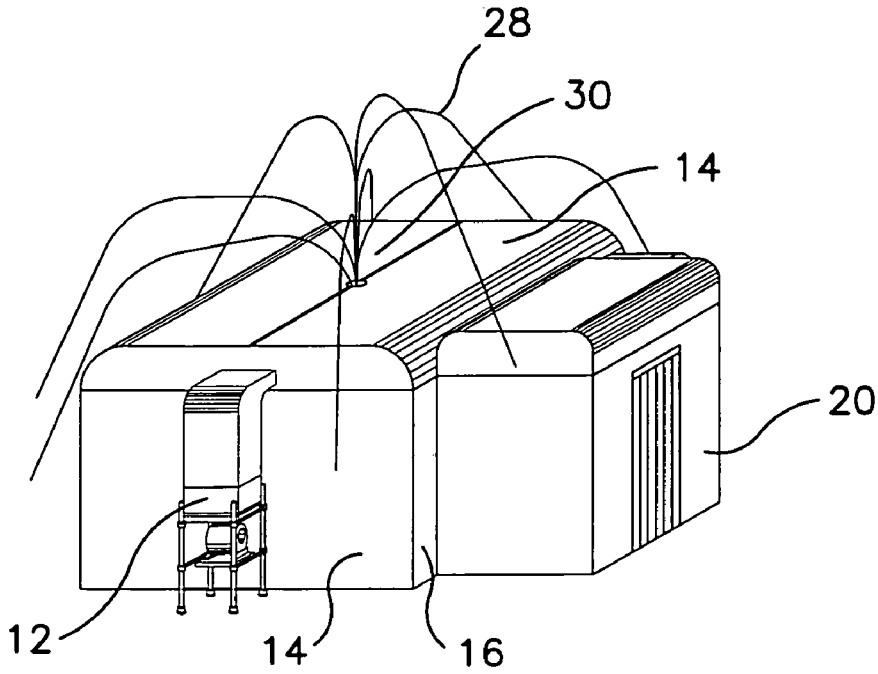
FIG. 5 is a perspective view of a single clean room and illustrating air escaping from an outlet in the top wall.
Figure 7:
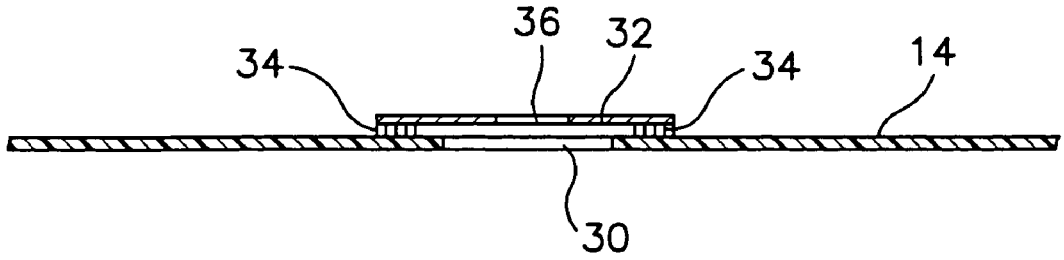
FIG. 7 is an enlarged fragmentary sectional view taken along lines 7-7 of FIG. 6.
Figure 6:
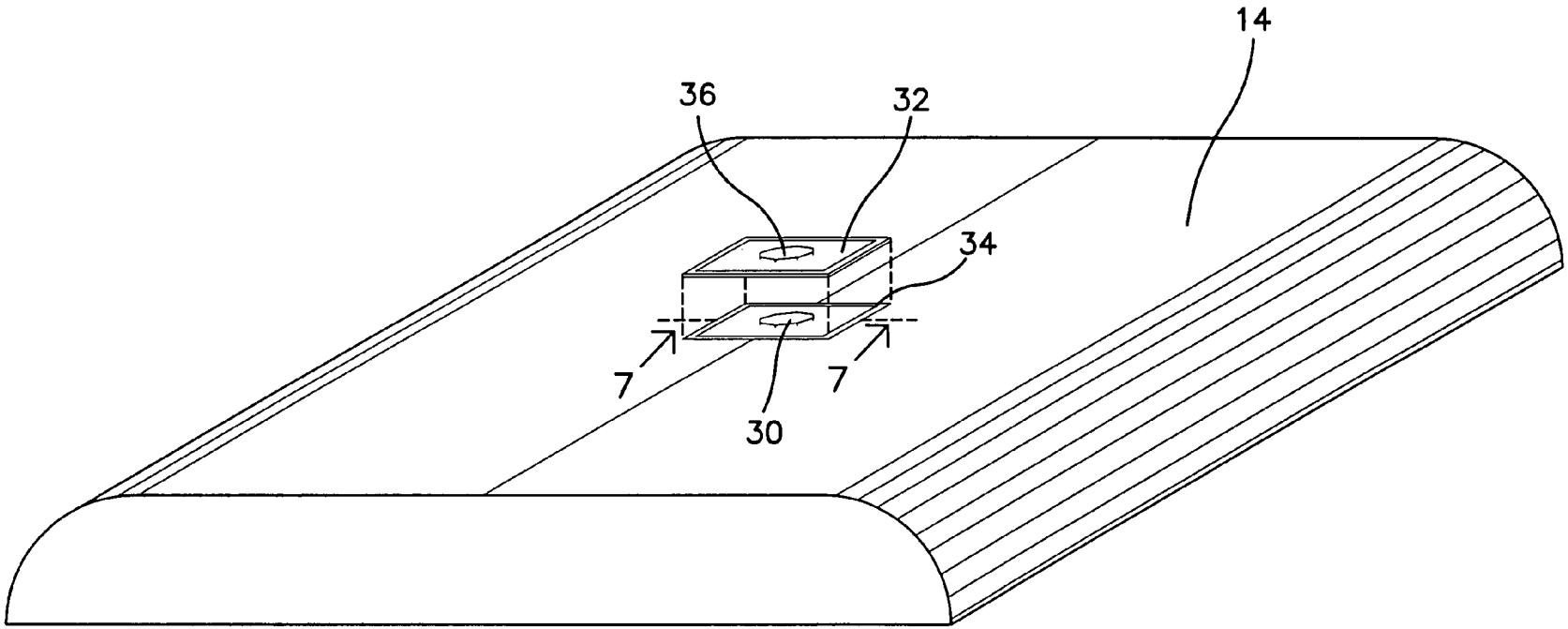
FIG. 6 is a perspective view of the top wall of the clean room shown in FIG. 5.

The height, and to some extent the dome-like shape, of the air bubbles 26 may also be influenced by the geometric configuration of the enclosure structure, which configuration can influence air currents within the enclosure surrounding the colony of clean rooms 10. It has also been found that this effect can to some extent be controlled and/or influenced by permitting a portion of the filtered air from within the clean rooms to escape in an upward direction from the top of the clean rooms as illustrated by the arcuate lines 28 in FIG. 5. This may be accomplished by providing at least one outlet 30 in the top wall 14. Each outlet 30 is preferably covered by a porous cover member 32, or a cover member having an opening 34 formed therein. The cover 32 is preferably releasibly attached to the top wall 14 by suitable means such as, for example, a Velcro® strip 34 surrounding the opening 30. The outlet 30 may also be partially (or entirely) closed by an imperious cover (not shown) of sheet material such as a vinyl sheet which may similarity be releasibly retained on top wall 30. Cover members 32 with various sized openings 36 may be selected to permit more or less air to escape from the top.

It has been found that limiting the amount of air which is permitted to escape through openings 30 to from about 10% to about 30% and preferably about 20% of the air discharged into each clean room 10 by the blowers 12 will not materially influence the horizontal extent of the dome of clean air bubbles encompassing a colony of clean rooms. At the same time, discharging HEPA-filtered air upward from the top of the clean rooms will enrich the surrounding bubble. By locating an outlet 30 in the top wall near the air lock door, or near another area where contamination could be encountered, the resulting enriched atmosphere of filtered air in the area can provide increased protection against contamination entry the clean rooms. The amount of traffic into and around the clean rooms may influence the cleanliness of the air bubbles 26 and therefore influence the amount of air which should be discharged from the top outlet 30 to maintain the desired cleanliness in the vicinity of the air lock doors 20.

The number of blowers associated with each clean room in the compound may to some extent depend on the size of the individual rooms and the desired frequency of replenishing the air in each room. Also, the size or capacity of the blowers may be reduced with an increase in their number so that the energy required for operation is not substantially increased by increasing the number of blowers associated with each clean room.

While I have disclosed and described preferred embodiments of my invention, it should be understood that the invention is not so limited, but rather that it is intended to include all embodiments thereof which would be apparent to one skilled in the art and which come within the spirit and scope of the invention.

I claim:

1. A method of operating a plurality of clean rooms in a compound within common area of an enclosing building structure, each said clean room consisting of a portable enclosure including a generally rectangular open frame covered on its top wall and sidewalls by a flexible, substantially air impermeable sheet material, air supply blower means outside of and connected to the clean room for providing filtered air into the room, and an entrance means through a sidewall providing access to the clean room, the method comprising, arranging the clean rooms in a compound consisting of two parallel spaced rows of clean rooms with an access corridor therebetween and with the entrances to the clean rooms of each row opening into the access corridor, providing a plurality of blowers operably connected to each clean room for supplying clean filtered air into the respective clean rooms and permitting air to escape from the clean room beneath the sidewalls thereof, continuously operating the blowers to produce a clean air bubble consisting of a volume of air containing at least about 75% recirculated filtered air which has escaped from the clean rooms, and arranging the clean rooms and the blowers in a pattern wherein the clean air bubble created by each blower overlaps the clean air bubble produced by at least two other blowers whereby the entire compound of clean rooms is contained within the overlapping bubbles produced by the blowers.

2. The method defined in claim 1, comprising providing at least three blowers connected to each clean room.

3. The method defined in claim 2, wherein one blower connected to each clean room is located in the corridor between the two rows of clean rooms.

4. The method defined in claim 1, wherein one blower connected to each clean room is located in the corridor between the two rows of clean rooms.

5. The method defined in claim 1, further comprising discharging a portion of the air from the clean room in an upward direction from an opening in the top wall.

6. The method defined in claim 3, further comprising discharging a portion of the air from the clean room in an upward direction from an opening in the top wall.

7. The method defined in claim 1, wherein each said clean room includes an air lock at its entrance means, and wherein one blower connected to each clean room is located adjacent said air lock.

8. The method defined in claim 1, wherein each said clean room includes an air lock at its entrance means, and wherein one blower connected to each clean room is located adjacent said air lock, and wherein a portion of the air in each clean room is discharged in an upwardly direction through an opening in its top wall.

9. The method defined in claim 8, wherein said opening in the top wall is located in the vicinity of said air lock.

10. The method defined in claim 2, wherein each said clean room includes an air lock at its entrance means, and wherein one blower connected to each clean room is located adjacent said air lock.

11. The method defined in claim 8, wherein each said clean room includes an air lock at its entrance means, and wherein one blower connected to each clean room is located adjacent said air lock.

12. The method defined in claim 9, wherein each said clean room includes an air lock at its entrance means, and wherein one blower connected to each clean room is located adjacent said air lock.

13. The method defined in claim 10, wherein two of said blowers are connected one adjacent diametrically opposed corners of each clean room on a wall generally perpendicular to the longitudinal direction of the rows of clean rooms.

14. The method defined in claim 5, wherein two of said blowers are connected one adjacent diametrically opposed corners of each clean room on a wall generally perpendicular to the longitudinal direction of the rows of clean rooms.

15. The method defined in claim 1, wherein said blowers are located to produce a greater overlap of the clean air bubbles in the area of the corridor between the rows of clean rooms to thereby reduce potential cross contamination between the clean rooms.

16. The method defined in claim 1, wherein said blowers are located to produce a greater overlap of the clean air bubbles in the area of the corridor between the rows of clean rooms to thereby reduce potential cross contamination between the clean rooms, and wherein a portion of the air in each clean room is discharged in an upwardly direction through an opening in its top wall.

17. The method defined in claim 1, wherein said blowers are located to produce a greater overlap of the clean air bubbles in the area of the corridor between the rows of clean rooms to thereby reduce potential cross contamination between the clean rooms, and wherein a portion of air discharged through said opening in the top wall is between 10 and 30 percent of the air discharged into the clean room by said blowers.

* * * * *